US011204209B2

(12) United States Patent
Craig

(10) Patent No.: US 11,204,209 B2
(45) Date of Patent: Dec. 21, 2021

(54) VARIABLE PORT MULTI-PISTON GAS-DELAYED BLOWBACK SYSTEM FOR FIREARM

(71) Applicant: Frederick Craig, Hutchinson, KS (US)

(72) Inventor: Frederick Craig, Hutchinson, KS (US)

( * ) Notice: Subject to any disclaimer, the term of this patent is extended or adjusted under 35 U.S.C. 154(b) by 0 days.

(21) Appl. No.: 17/021,949

(22) Filed: Sep. 15, 2020

(65) Prior Publication Data

US 2021/0116190 A1 Apr. 22, 2021

Related U.S. Application Data

(60) Provisional application No. 62/901,869, filed on Sep. 18, 2019.

(51) Int. Cl.

| | |
|---|---|
| ***F41A 3/62*** | (2006.01) |
| ***F41C 23/06*** | (2006.01) |
| ***F41A 3/54*** | (2006.01) |

(52) U.S. Cl.

CPC ..... *F41A 3/62* (2013.01); *F41A 3/54* (2013.01); *F41C 23/06* (2013.01)

(58) Field of Classification Search

CPC ..... F41A 3/54; F41A 3/62; F41C 23/06

USPC ..... 89/191.01, 192

See application file for complete search history.

(56) References Cited

U.S. PATENT DOCUMENTS

| | | | | | |
|---|---|---|---|---|---|
| 2,887,013 | A * | 5/1959 | Marsh | F41A 21/28 | 89/193 |
| 3,069,976 | A * | 12/1962 | Stevens, Jr. | F41A 17/32 | 89/147 |
| 3,988,964 | A * | 11/1976 | Moore | F41A 5/28 | 89/185 |
| 4,580,484 | A * | 4/1986 | Moore | F41A 3/44 | 42/77 |
| 4,909,129 | A * | 3/1990 | Reynolds | F41A 5/18 | 89/187.01 |
| 5,404,790 | A * | 4/1995 | Averbukh | F41A 5/28 | 89/193 |
| 5,734,120 | A * | 3/1998 | Besselink | F41A 3/14 | 89/163 |
| 6,112,636 | A * | 9/2000 | Besselink | F41A 5/18 | 89/184 |
| 6,622,610 | B2 * | 9/2003 | Adkins | F41A 3/62 | 89/193 |
| 9,574,835 | B2 * | 2/2017 | Pflaumer | F41C 3/00 | |
| 2011/0017058 | A1 * | 1/2011 | Kaminsky | F41C 3/00 | 89/191.01 |

* cited by examiner

*Primary Examiner* — Bret Hayes
(74) *Attorney, Agent, or Firm* — Intellectual Property Consulting, LLC; Adam V. Vickers

(57) ABSTRACT

A gas-delayed blowback system for a firearm preferably includes a receiver, a barrel and a spring-loaded moveable slide. The barrel is ported to at least two gas compression chambers into which expanding propellant gases flow after the firearm is fired. The gas compression chambers and ports vary in volume such that propellant gas pressure increases rapidly in one of the chambers, thereby locking the slide upon firing. Pressure in the other gas compression chambers increases and decreases at a slower rate due to a smaller port size, further delaying rearward travel of the slide after the bullet exits the barrel and barrel pressure is relieved.

20 Claims, 8 Drawing Sheets

VARIABLE PORT MULTI-PISTON GAS-DELAYED BLOWBACK SYSTEM FOR FIREARM

RELATED APPLICATIONS

This application claims priority to U.S. Provisional Application No. 62/901,869 filed Sep. 16, 2019. The entire contents of the above application are hereby incorporated by reference as though fully set forth herein.

FIELD OF THE INVENTION

The present invention relates to the field of firearms. More specifically, the present invention relates to a gas-delayed blowback recoil system for a firearm.

BACKGROUND

Blowback is the general operating recoil system of an autoloading firearm in which pressure from expanding propellant gases released after firing, drives the breech slide or bolt from the full battery position rearward to the full out of battery position. During the travel of the slide rearward, the spent cartridge case is ejected and then as the slide travels forward it picks up a new unfired cartridge from the magazine and loads it into the cartridge chamber of the barrel as the slide breech closes against the barrel to full battery position once again. This type of recoil system is limited to lower pressure cartridges.

In the early 1900's the firearms world was quickly evolving from the use of revolvers and lever actions to the use of semi-automatic self-loading designs. These designs were driven by the development of new higher-pressure cartridges like the 9 mm Luger. Various new recoil systems emerged in sidearm development to accommodate these higher-pressure cartridges. Blowback system designs progressed to include a semi-locked breech mechanism. This type of a recoil system is referred to as delayed blowback.

Delayed blowback recoil systems like the Browning M1911 are examples of this technology. Most delayed blowback designs like the M1911 for example, use a mechanical lock to create a dwell or hesitation upon firing to allow cartridge chamber pressures to drop before the cartridge case is extracted from the barrel chamber. Others like the gas delayed blowback use gas pressure from the barrel chamber to create the dwell or hesitation needed before safely ejecting the cartridge case.

The straight blowback system evolved to employ a gas delayed mechanism which incorporated a piston and chamber design. An example is disclosed in U.S. Pat. No. 954,441, by Ole Herman Johannes Krag (1910). When fired, propellant gases push the slide rearward toward the unlocked position. At the same time, propellant gases also flow from the barrel through a fill port and into a gas chamber which houses a piston connected to the slide. The piston compresses the propellant gases which slows the slide travel so that the bullet exits the barrel before the slide reaches the unlocked position. The delay in cycling action allows maximum gas propulsion of the bullet, and it allows gas to drop enough for safe expulsion of the spent cartridge. Although somewhat crude, Krag's single piston design was chambered in the new high-pressure German 9 mm parabellum cartridge. However, this new firearm was not well received, as it imposed significant felt recoil on the user and the system experienced a high failure rate after several cycles.

Gas delayed blowback design improved. In the 1970's the German company Heckler & Koch debuted their new military and law enforcement handgun the HK-P7 in 9 mm parabellum. Much like the Krag design, the P7 was basically a common blow back design having a fixed frame mounted barrel, a recoil spring positioned over the barrel shank, and a slide that lifted off the top of the frame for disassembly, with the addition of a single piston gas delay mechanism. The major difference was in the design of the piston and gas chamber. The P7 piston was larger in diameter, and utilized several grooves machined into the outside diameter of the piston shank. These grooves improved the compression characteristics of the system, which ultimately reduced the slide inertia significantly. This in turn allowed for a lighter and smaller slide than the P7's predecessors. The P7 handled the 9 mm parabellum ammunition well, and was well received in the market, but the P7's downfall came in the early 1990's when the 40 S&W cartridge was adopted by the United States law enforcement community. This new cartridge was significantly more powerful than the 9 mm parabellum, and the P7 was no match for a cartridge of this pressure. The HK engineers failed to effectively adapt the single piston design to match the power of the 40 S&W cartridge, and the P7 fell out of favor in subsequent years.

However, gas-delay systems do have some inherent advantages over other delay systems. Gas delays utilize a fixed barrel. Mechanical delayed systems must use a moving barrel to help create the delay. Accuracy is lost when the barrel must move after each shot is fired. Therefore, gas-delayed systems are inherently more accurate. Also, modern gas-delay systems would be capable of utilizing less slide mass than their mechanical counter parts, as well as having the ability to self-regulate pressure from the cartridge, which in turn translates into a smaller, lighter, and more accurate firearm with much better recoil handling capabilities.

Gas-delayed blowback designs of the past have fallen short for several reasons. Most importantly these inventors failed to understand the objectives of a gas delay, and to separate those objectives, in order to exploit the individual potential of each objective. For a gas-delay recoil system to work effectively, one must understand and address the two primary objectives of a gas-delay recoil system. The first objective of a gas-delay is to create a gas lock or gas brake of the breech to the barrel cartridge chamber, i.e., to create the delay. This gas lock must lock quickly and must be able to maintain this braking effect for the desired duration. The second objective of a gas delay is to buffer the recoiling force of the slide. Neither duty can be adequately accomplished with a single piston design. Locking forces and compression forces are completely different, so to accomplish both effectively, there must be two or more pistons and accompanying gas chambers. Accordingly, there is a need for a variable-port, multi-piston gas-delayed blowback system which employs separate locking and compression phases after the firearm is fired.

BRIEF SUMMARY OF THE INVENTION

The present invention meets this need by providing an autoloading firearm with a variable-port multi-piston gas-delayed blowback system. According to one aspect of the invention, a receiver is provided for chambering an ammunition cartridge and a barrel is provided with a cartridge chamber end and a discharge end. Also provided is a spring-loaded mobile slide enveloping the barrel and operable to move along the axial length of the barrel.

The present invention provides at least two gas chambers operable to temporarily lock the firearm, delay rearward slide travel, and reduce felt recoil after it is fired. The gas chambers are ported to the internal cavity of the barrel at the cartridge chamber end such that propellant gases from a fired cartridge flow into each gas chamber after the firearm is fired. Baffled pistons are connected to the discharge end of the slide and disposed within each gas chamber so that each piston slides into its respective gas chamber when the slide moves rearward.

When the user fires the firearm, propellant gases exit the cartridge and expand at a very high rate, thereby forcing the bullet toward the discharge end of the barrel. The propellant gases also force the slide rearward toward the unlocking position. However, it is crucial to delay unlocking of the firearm long enough for the bullet to first exit the discharge end of the barrel to ensure maximum propulsion of the bullet and to ensure discharge of the spent cartridge under a safe pressure. To delay unlocking, propellant gases flow through the gas chamber ports and into the gas chambers. The pistons compress the propellant gases within the gas chambers after the slide is initially forced rearward by immediate propellant gas expansion upon firing. The resulting compression forces within the gas chambers act against the pistons, thereby delaying the slide's rearward travel and firearm unlocking.

The difference in gas chamber sizes and gas chamber port sizes create a multi-phase gas chamber compression dynamic. The locking gas chamber has a smaller volume than the compression gas chamber. The locking gas chamber port is larger than the compression gas chamber port. Consequently, propellant gases flood the locking gas chamber at a higher rate than they flow into the compression gas chamber. The locking gas chamber fills first after the firearm is fired, which instantaneously yet temporarily locks the slide until the bullet exits the barrel. The instantaneous and short-lived locking phase achieved with the relatively large locking gas chamber port is an industry advancement.

After the bullet exits the barrel, pressure within the barrel decreases and propellant gases begin to exit the gas chambers through the gas chamber ports as slide momentum forces the slide rearward and the pistons further into the gas chambers. Propellant gases from the locking gas chamber are expelled at a higher rate compared with propellant gases within the compression chamber given the relative port ratios. As the slide and pistons continue rearward, compressive force is exerted on the compression chamber piston to slow slide travel and further delay expulsion of the spent cartridge. Moreover, felt recoil is reduced compared with current gas-delayed blowback firearms because propellant gas forces are dispersed over more surface area given the multiple gas chambers and at least one additional piston. As a result, high-pressure ammunition may be used with a comparatively low felt recoil achieved by modern locked-breech firearms.

DETAILED DESCRIPTION OF THE INVENTION

Figure 1:
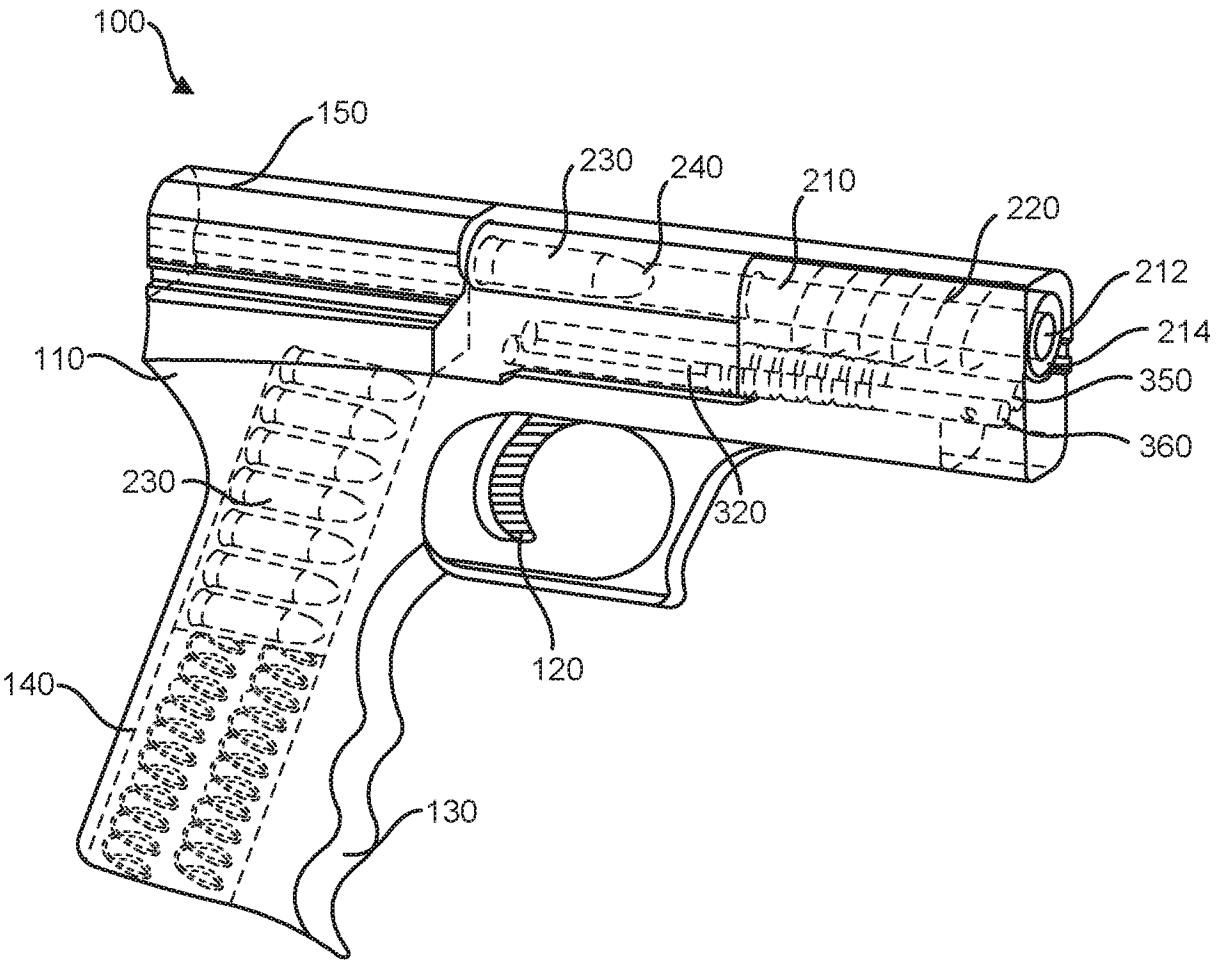
FIG. 1 is a perspective view of one embodiment of the invention in the firing position showing the internal mechanisms with two gas compression chambers and two pistons.
Figure 2:
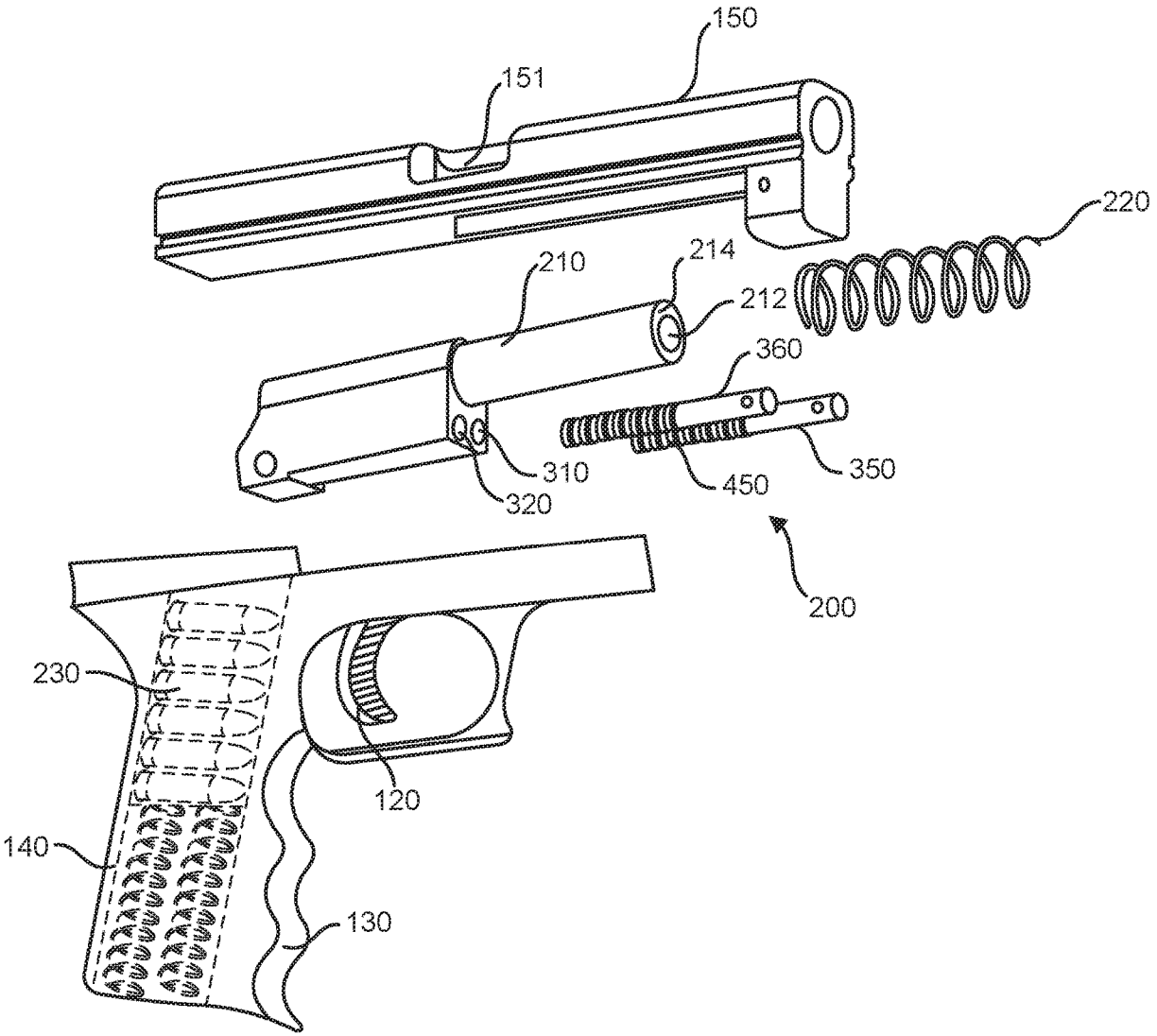
FIG. 2 is an exploded perspective view of one embodiment showing the components of the gas-delayed blowback system.

FIG. 1 shows one embodiment of certain internal components of firearm 100 while it is loaded and in the full battery firing position. For this embodiment, the firearm 100 includes a receiver 110, a trigger 120, a grip 130, a magazine 140, a slide 150 with an ejection port 151, and a barrel 210. FIG. 2 is an exploded view of the embodiment in FIG. 1 and further illustrates the components of firearm 100.

Figure 3A:
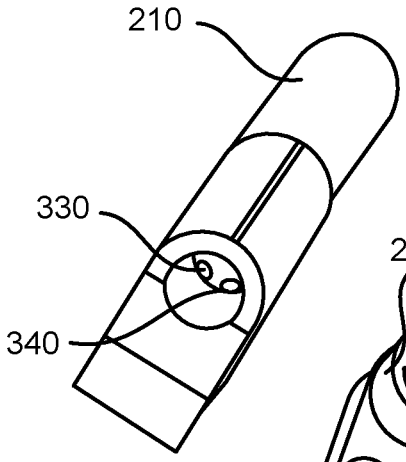
FIG. 3A shows a perspective view of one embodiment of the barrel viewed from the chamber end.
Figure 3B:
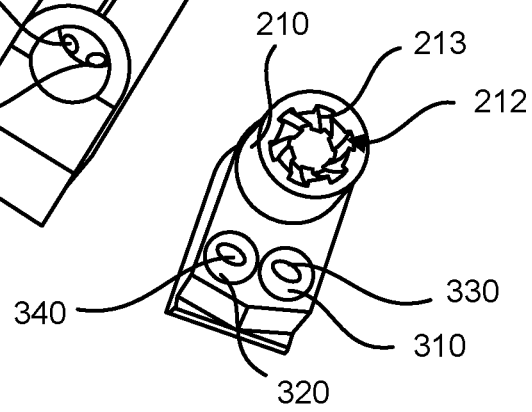
FIG. 3B shows a perspective view of one embodiment of the barrel viewed from the discharge end.

Receiver 110 is commonly known as the firearm frame. It typically houses the firing mechanisms, cartridge magazine and cartridges. The barrel 210 is attached to receiver 110. Barrel rifling 213, known in the industry as an arrangement of spiral grooves on the inside of a barrel, may be disposed within barrel bore 212 as depicted in FIG. 3B. Slide 150 is removably attached to receiver 110 and may envelope barrel 210. Slide 150 is operable to slide along the longitudinal axis of barrel 210 when firearm 100 is fired or in response to hand-applied force.

In one embodiment, recoil spring 220 enwraps barrel 210 inside of slide 150 and forces slide 150 forward into the full battery position where slide 150 remains until firearm 100 is fired or the user moves slide 150 by hand. Alternatively, the recoil spring 220 may enwrap a guide rod (not shown) attached to receiver 110 and located below barrel 210. The foregoing arrangement of components is generally known in the art.

The present invention improves on the art by using the disclosed gas-delayed blowback system 200 of firearm 100. Components of the gas-delayed blowback system 200 are shown in FIGS. 2-5. In one embodiment, the components of gas-delayed blowback system 200 include barrel 210 with a cartridge chamber 211 and a discharge end 214, a recoil spring 220, a locking gas chamber 310, a compression gas chamber 320, a locking gas chamber port 330, a compression gas chamber port 340, a locking gas chamber piston 350, a compression gas chamber piston 360, and piston baffles 450.

Figure 3C:
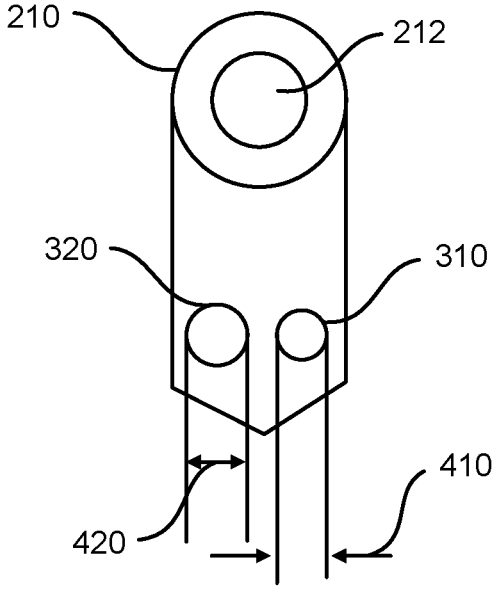
FIG. 3C shows a cross-section of one embodiment of the barrel.
Figure 4:
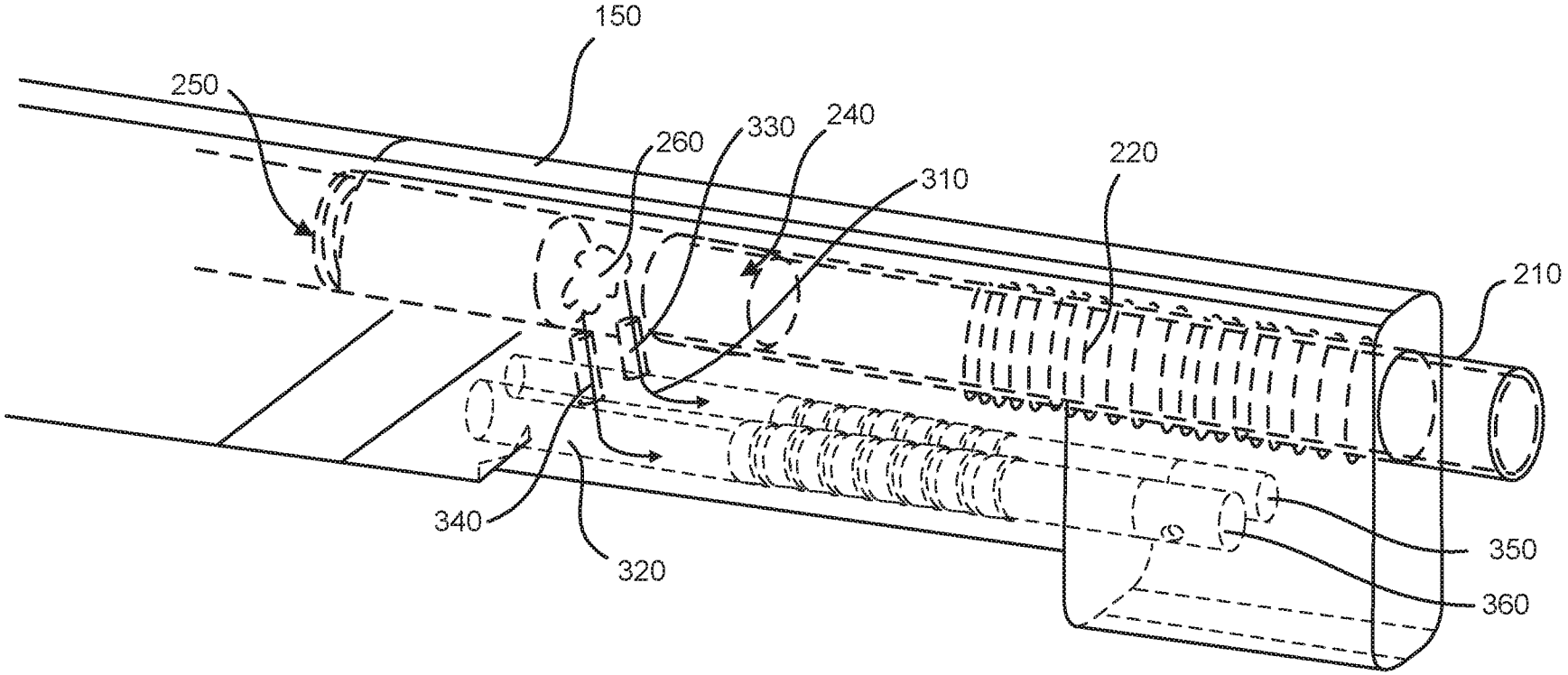
FIG. 4 shows a perspective view of one embodiment of the invention immediately after it has been fired.

Cartridge chamber 211 is operable to hold an ammunition cartridge such as loaded cartridge 230 depicted in FIG. 1. As shown in FIG. 4, locking gas chamber 310 and compression gas chamber 320 are both ported to the internal cavity of barrel 210 by locking gas chamber port 330 and compression gas chamber port 340, respectively. In one embodiment, locking gas chamber 310 and compression gas chamber 320 cylindrical and have identical bore lengths. However, as shown in FIG. 3C, locking gas chamber bore diameter 410 is smaller than compression gas chamber bore diameter 420, resulting in a lower relative chamber volume for locking gas chamber 310. In one embodiment, locking gas chamber bore diameter 410 is at least 0.220 inches and up to 0.250 inches, and compression gas chamber bore diameter 420 is at least 0.250 inches and up to 0.500 inches.

Locking gas chamber port bore diameter 430 is larger than compression gas chamber port bore diameter 440, resulting in a higher volume for locking gas chamber port 330. In one embodiment, locking gas chamber port bore diameter 430 is at least 0.068 inches and up to 0.085 inches, and compression gas chamber port bore diameter 440 is at least 0.052 inches and up to 0.062 inches.

In one embodiment, compression gas chamber port 340 may be juxtaposed to locking gas chamber port 330 within the body of cartridge chamber 211. In an alternative embodiment, locking gas chamber port 330 may be located in the body of cartridge chamber 211, and compression gas chamber port 340 may be located within the leade (not shown) of cartridge chamber 211. The leade is commonly known in the art as a short section of the cartridge chamber in which the chamber transitions to the barrel bore. Thus, compression gas chamber port 340 may be located further toward discharge end 214 than locking gas chamber port 330.

Locking gas chamber piston 350 and compression gas chamber piston 360 may be connected to slide 150 and are disposed within locking gas chamber 310 and compression gas chamber 320. Locking gas chamber piston 350 and compression gas chamber piston 360 fit within their respective gas chambers with a minimal tolerance of generally 0.0001 to 0.0002 inches. In one embodiment, pistons 350 and 360 may be removably attached to slide 150, by for example, slot pins or other fastening means known in the art, to ease assembly and disassembly of firearm 100 and to ease removal of pistons 350 and 360 from slide 150.

As shown in FIGS. 1, 4, 5 and 6, pistons 350 and 360 are operable to slide into locking gas chamber 310 and compression gas chamber 320 as slide 150 moves rearward, thereby compressing gases within each gas chamber. In one embodiment, baffled pistons such as those depicted provide for multi-stage compression as early-stage piston baffles 450 allow anticipated "blow-by" of propellant gases 260 after firearm 100 is fired. The slight tolerance of piston baffles 450 within locking gas chamber 310 and compression gas chamber 320 provides stability by ensuring linear piston movement and decreasing "flutter", maximizes compression, and maximizes firearm cleaning intervals by distributing propellant fouling within the successive grooves between piston baffles 450. In an alternative embodiment, at least two piston baffles 450 are disposed within each of locking gas chamber 310 and compression gas chamber 320 when firearm 100 is in the full battery firing position (FIG. 1). Such arrangement ensures at least two piston baffles 450 preserve compression within locking gas chamber 310 immediately after firing and allows sufficient chamber bore length for compression dampening as slide 150 travels rearward.

As with typical firearms, the present invention is fired when the user pulls trigger 120 which activates an internal firing mechanism (not pictured) that acts upon loaded cartridge 230 within cartridge chamber 211. Specifically, the internal firing mechanism strikes the primer of loaded cartridge 230. The primer ignites propellant within loaded cartridge 230, which rapidly expands as it converts to propellant gases 260 and forces bullet 240 out of loaded cartridge 230 and down barrel 210 toward discharge end 214.

As shown in FIG. 4, after the primer is struck and propellant is ignited, propellant gases 260 force slide 150 rearward as they continue to expand. In one embodiment, as well-known in the industry, a bolt may provide the same function as slide 150 depicted herein. Propellant gases 260 flow through locking gas chamber port 330 and compression gas chamber port 340, and into locking gas chamber 310 and compression gas chamber 320. The higher cross-sectional area of locking gas chamber port 330 compared with the lower cross-sectional area of compression gas chamber port 340 allows propellant gases 260 to flow into locking gas chamber 310 much faster than they flow into compression gas chamber 320. As a result, the pressure within locking gas chamber 310 increases much faster than the pressure within compression gas chamber 320 due to the higher flow rate into locking gas chamber 310. Pressure may increase even faster if the volume of locking gas chamber 310 is lower than the volume of compression gas chamber 320. The relatively high compression force of propellant gases 260 acting against locking gas chamber piston 350 delays slide travel by instantaneously yet temporarily locking it in place as bullet 240 travels down barrel 210 toward discharge end 214. This is known as the locking phase.

Figure 5:
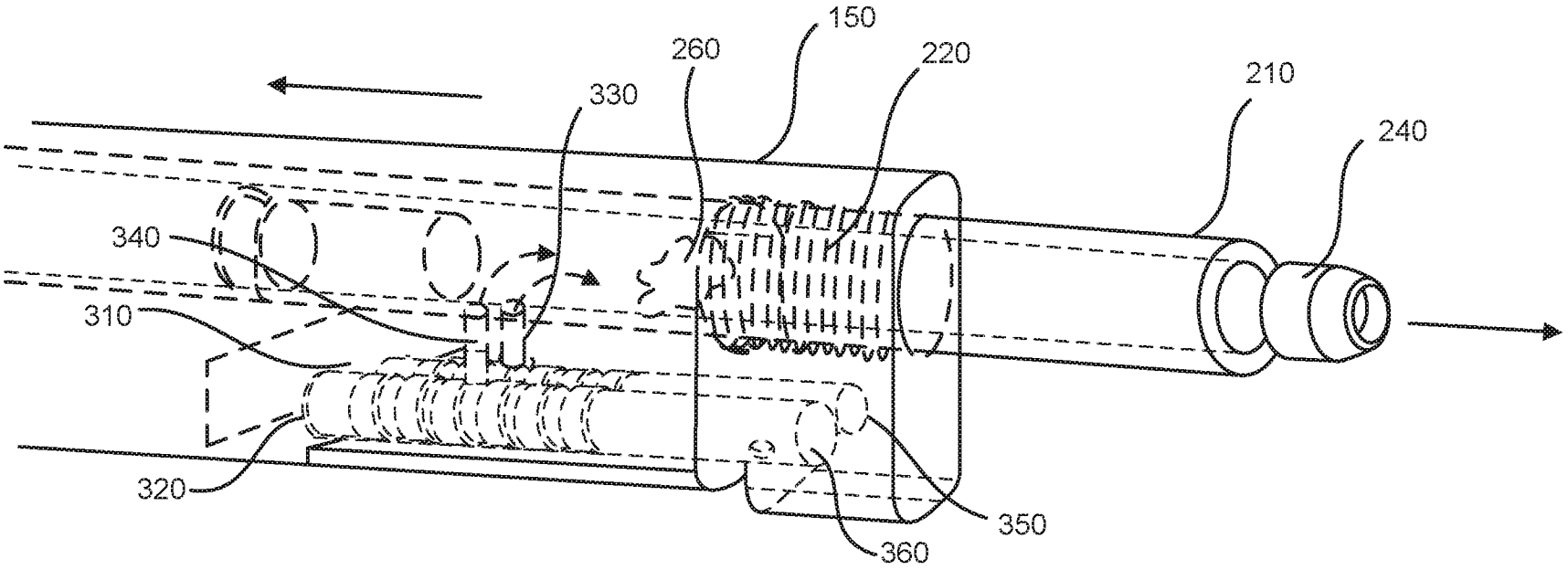
FIG. 5 shows a perspective view of one embodiment of the invention as the bullet exits the barrel.

As shown in FIG. 5, the pressure created by propellant gases 260 within barrel 210 rapidly decrease as bullet 240 exits discharge end 214. The rearward momentum of slide 150 overcomes the temporary lock. The locking phase ends and the compression phase begins.

In the compression phase, slide 150 travels rearward as propellant gases 260 are expelled through locking gas chamber port 330 and into barrel 210. However, rearward travel of slide 150 is slowed as compressive gases within compression gas chamber 320 act against compression gas chamber piston 360. Compression gas chamber port bore cross-sectional area 440 is sized and dimensioned to limit the volumetric flow rate of propellant gases 260 from within compression gas chamber 320 outward through compression gas chamber port 340, such that sufficient force acts against compression gas chamber piston 360 to slow the rearward travel of slide 150. Consequently, slide 150 does not reach the full recoil position until after bullet 240 has exited discharge end 214.

In one embodiment, compression gas chamber port 340 may be located further toward discharge end 214 than locking gas chamber port 330. Such positioning increases compression within compression gas chamber 320 because compression gas chamber piston 360 will slide past compression gas chamber port 340 early during the compression phase, thereby reducing the amount of propellant gases 260 which are forced out through compression gas chamber port 340 by sealing them within compression gas chamber 340. The result is increased recoil buffering and reduced felt recoil, preferable for large-caliber high-energy cartridges known in the art such as the 40 S&W and 10 mm.

Figure 6:
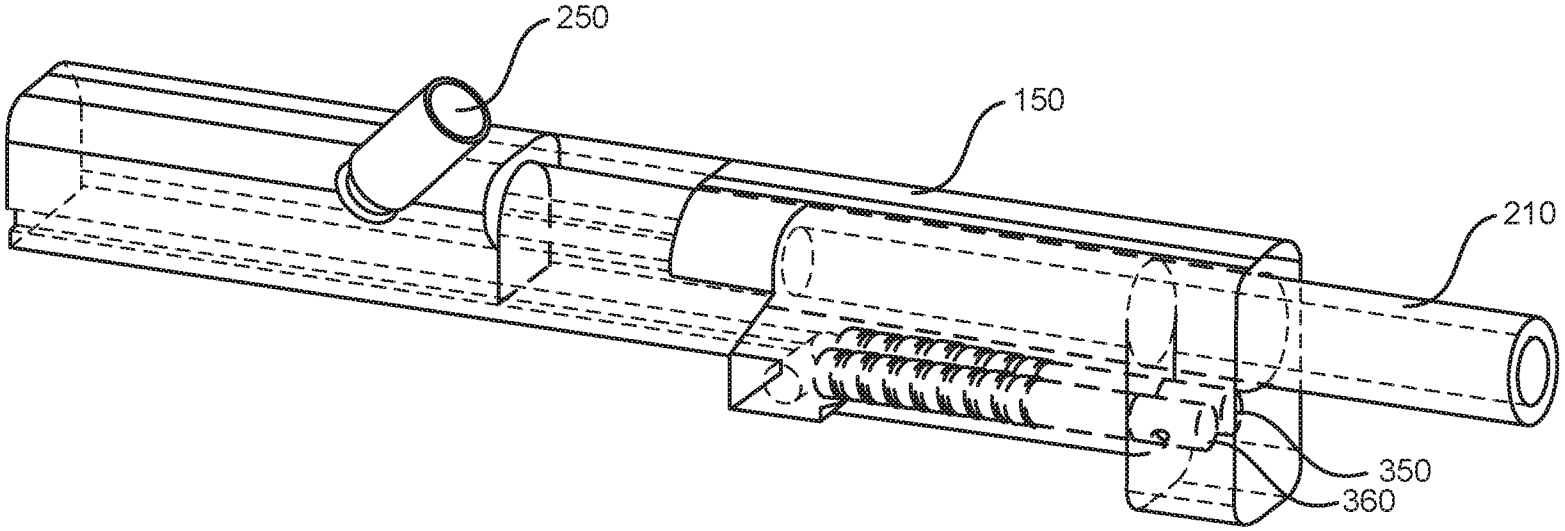
FIG. 6 shows a perspective view of one embodiment of the firearm in the full recoil position.

As shown in FIG. 6, When slide 150 reaches the full recoil position, spent cartridge 250 is ejected through ejection port 151 under a significantly reduced pressure. A new loaded cartridge 230 is forced from magazine 140 into cartridge chamber 211, and recoil spring 220 forces slide 150 back to the full battery position.

The dispersal of propellant gases 260 into more than one variable-sized and ported gas chambers allows firearm 100 to sufficiently delay unlocking when modern high-pressure ammunition cartridges such as the 9 mm parabellum are fired. The initial locking phase enables the breech to be locked almost instantaneously after firing, which is a distinct improvement over previous gas-delayed blowback designs. Instantaneous lock delays muzzle flip caused by recoil, which increases accuracy. The initial locking phase also reduces the potential for cartridge case rupture as the propellant gas forces are dispersed within locking gas chamber 310 and against locking gas chamber piston 350, thereby increasing overall firearm safety.

An additional benefit of the present invention is reduced felt recoil with high pressure ammunition cartridges, particularly as a result of the second compression phase. The momentum of slide 150 imposes felt recoil against the user when it reaches the full recoil position. Felt recoil is undesirable because it decreases the degree of control the user has over the firearm, reduces accuracy and it can harm the user. Preceding gas-delayed blowback systems used only one piston-and-chamber assembly. Consequently, felt recoil dampening was insufficient for high-pressure ammunition cartridges such as the now ubiquitous 9 mm parabellum. Significant felt recoil reduced the shooter's ability to fire quick consecutive and accurate shots. Heavy recoil also imposed extreme wear on the firearm components which caused frequent mechanical failures.

The current design redirects the force of propellant gases 260 to act against the momentum of slide 150 and against gas chambers 214 and 215 to decrease felt recoil. Use of multiple piston-and-chamber assemblies improves current technology by slowing slide momentum in two stages—the locking stage and compression stage. Moreover, the interior surface areas of locking gas chamber 310 and compression gas chamber 320 provide more surface area to absorb propellant gas force than configurations currently known in the art. As a result, the user does not suffer felt recoil typical of other gas-delayed blowback firearms when a high-pressure ammunition cartridge is fired.

Figure 7:
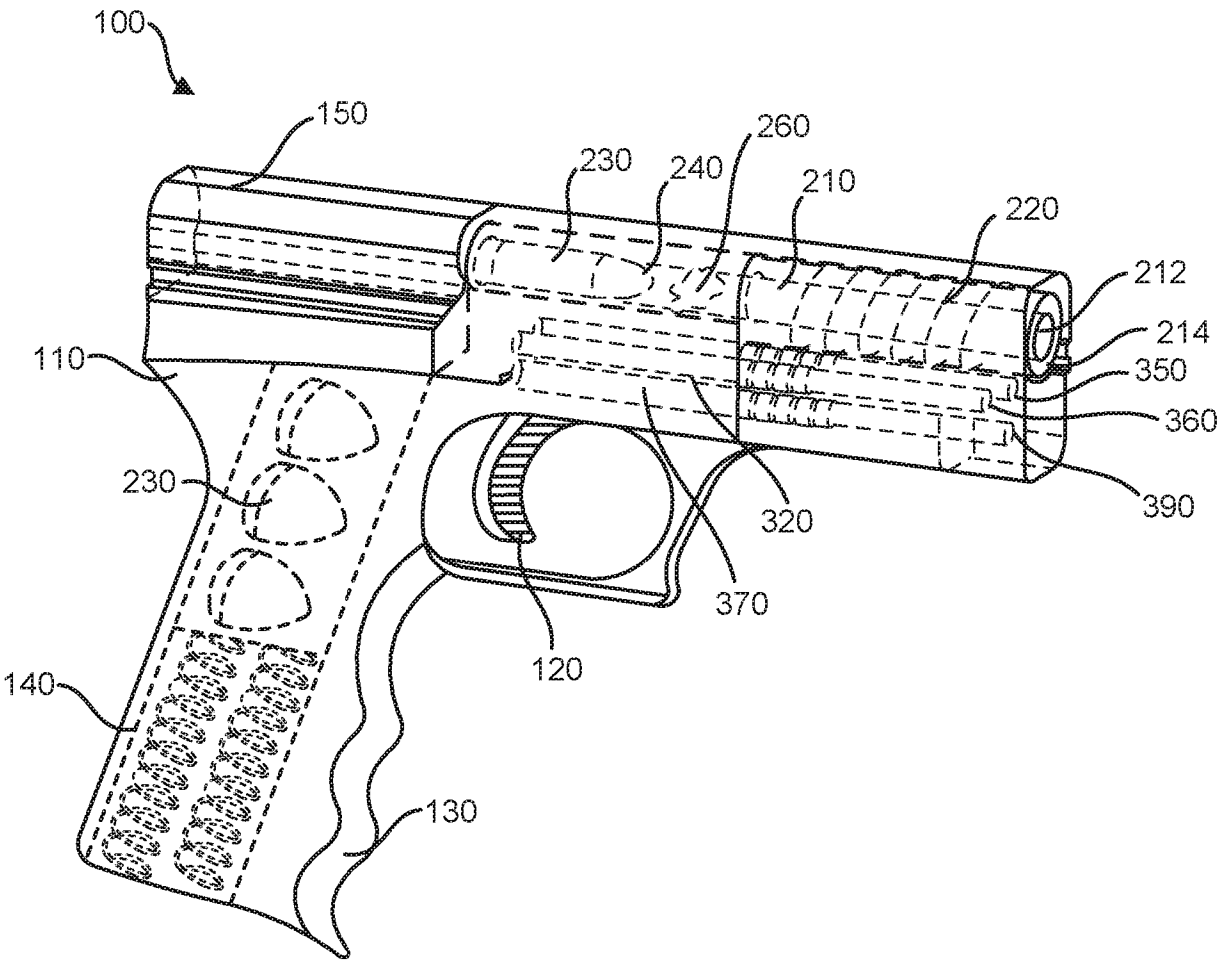
FIG. 7 is a perspective view of a second embodiment of the invention in the firing position showing the internal mechanisms with three gas compression chambers and three pistons.
Figure 8:
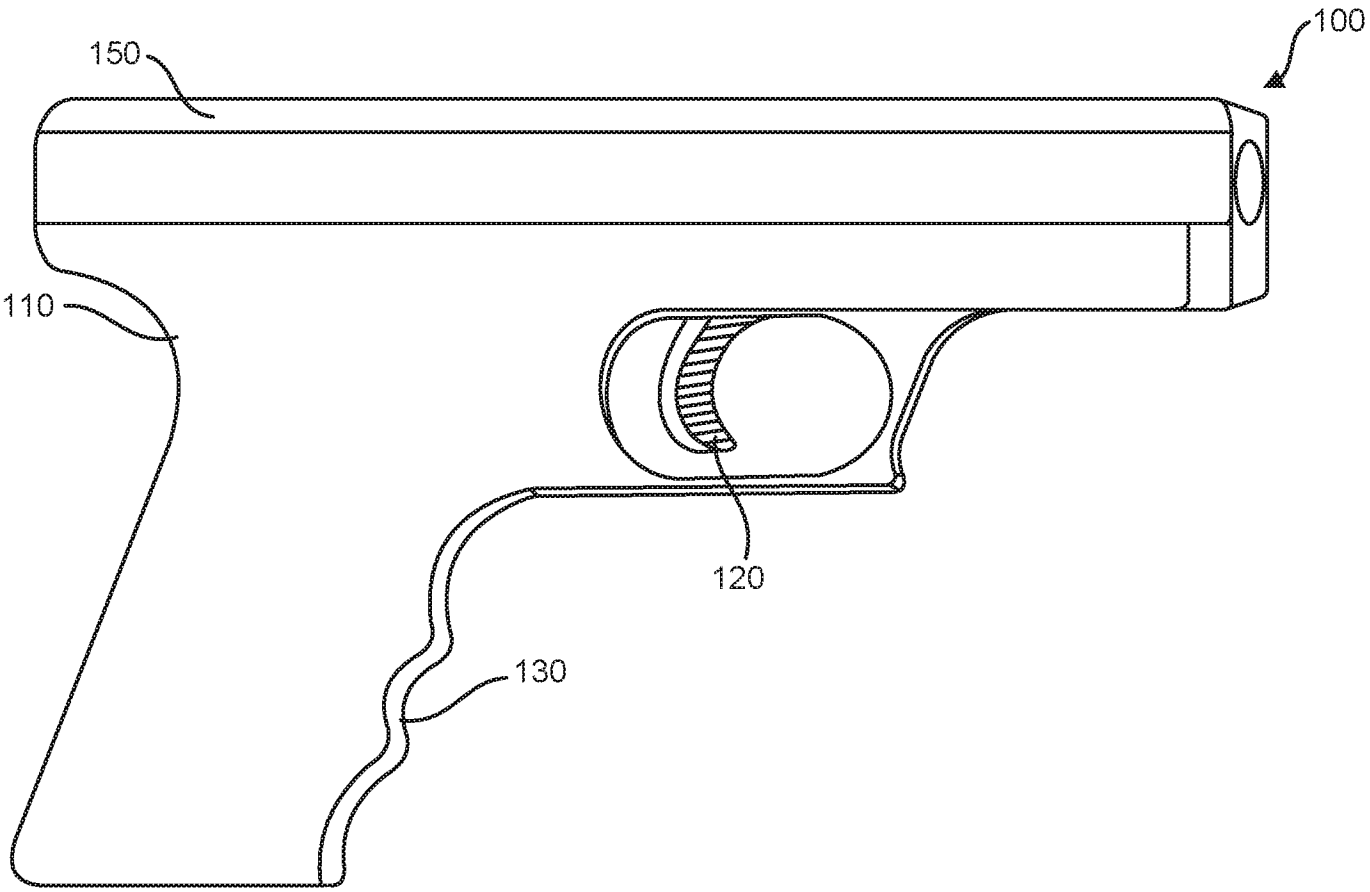
FIG. 8 shows an external perspective view of the invention.

Turning to FIG. 7, an alternative embodiment with a second compression gas chamber 370 is provided. The second compression gas chamber 370 houses second compression gas chamber piston 390 and is ported to barrel bore 212 via a second compression gas chamber port (not shown). The second compression gas chamber 370 may include the same or similar dimensions as compression gas chamber 320 and, likewise, the second compression gas chamber port may include the same or similar dimensions as compression gas chamber port 340. Upon firing of firearm 100, propellant gases 260 may flow through the second compression gas chamber port and into second compression gas chamber 370. The addition of second compression gas chamber 370, the second compression gas chamber port and second compression gas chamber piston 390 should provide additional compressive forces against the momentum of slide 150 during the compression phase, thereby further delaying rearward travel of slide 150 and further reducing felt recoil.

What is claimed is:

1. An autoloading firearm comprising:

a receiver for chambering an ammunition cartridge;

a barrel comprising an inner bore, a cartridge chamber end and a discharge end;

a spring-loaded mobile slide operable to move along the axial length of said barrel, wherein expanding propellant gases from a fired cartridge force said slide rearward along said barrel when said firearm is fired;

a gas-delayed blowback system comprising:

a locking gas chamber ported to the inner bore of said barrel, wherein said locking gas chamber is cylindrical, has a bore diameter, and is operable to receive expanding propellant gases through a locking gas chamber port upon firing of said firearm;

a first compression gas chamber ported to the inner bore of said barrel, wherein said first compression gas chamber is cylindrical, has a bore diameter, and is operable to receive expanding propellant gases through a first compression gas chamber port upon firing of said firearm; and a piston disposed within each said gas chamber, connected to said slide and configured to move rearward into each said gas chamber when said slide moves rearward.

2. The firearm of claim 1, wherein a plurality of piston baffles are disposed along a longitudinal axis of each said piston.

3. The firearm of claim 2, wherein at least two of said piston baffles on each said piston are disposed within each said gas chamber when said firearm is in the firing position.

4. The firearm of claim 1, wherein said bore diameter of said locking gas chamber is smaller than said bore diameter of said first compression gas chamber.

5. The firearm of claim 1, wherein said locking gas chamber port is cylindrical and has a bore diameter, and said first compression gas chamber port is cylindrical and has a bore diameter.

6. The firearm of claim 5, wherein said bore diameter of said locking gas chamber port is larger than said bore diameter of said first compression gas chamber port.

7. The firearm of claim 6, wherein said bore diameter of said locking gas chamber measures at least 0.220 inches and up to 0.250 inches.

8. The firearm of claim 7, wherein said bore diameter of said first compression gas chamber measures at least 0.250 inches and up to 0.500 inches.

9. The firearm of claim 8, wherein said bore diameter of said locking gas chamber port measures at least 0.068 inches and up to 0.085 inches.

10. The firearm of claim 9, wherein said bore diameter of said first compression gas chamber port measures at least 0.052 inches and up to 0.062 inches.

11. The firearm of claim 1, wherein said firearm further comprises a second compression gas chamber which is cylindrical and has a bore diameter.

12. The firearm of claim 11, wherein said bore diameter of said locking gas chamber is smaller than said bore diameter of said first compression gas chamber and said bore diameter of said second compression gas chamber.

13. A gas-delayed blowback system for an autoloading firearm comprising:

a locking gas chamber ported to an inside of a barrel, wherein said locking gas chamber is cylindrical, has a bore diameter, and is operable to receive expanding propellant gases through a locking gas chamber port upon firing of said firearm;

a first compression gas chamber ported to the inside of said barrel, wherein said first compression gas chamber is cylindrical, has a bore diameter, and is operable to receive expanding propellant gases through a first compression gas chamber port upon firing of said firearm; and a piston disposed within each said gas chamber, connected to a movable slide and operable to move rearward into each said gas chamber when said slide moves rearward, wherein said bore diameter of said locking gas chamber is smaller bore than said bore diameter of said first compression gas chamber, wherein said locking gas chamber port is cylindrical and has a bore diameter, and said first compression gas chamber port is cylindrical and has a bore diameter, and wherein said bore diameter of said locking gas chamber port is larger than said bore diameter of said first compression gas chamber port.

14. The firearm of claim 13, wherein a plurality of piston baffles are disposed along a longitudinal axis of each said piston.

15. The firearm of claim 14, wherein at least two of said piston baffles on each said piston are disposed within each said gas chamber when said firearm is in the firing position.

16. The firearm of claim 13, wherein said bore diameter of said locking gas chamber measures at least 0.220 inches and up to 0.250 inches.

17. The firearm of claim 16, wherein said bore diameter of said compression gas chamber measures at least 0.250 inches and up to 0.500 inches.

18. The firearm of claim 17, wherein said bore diameter of said locking gas chamber port measures at least 0.068 inches and up to 0.085 inches.

19. The firearm of claim 18, wherein said bore diameter of said compression gas chamber port measures at least 0.052 inches and up to 0.062 inches.

20. A method for delaying unlocking and buffering recoil forces in an autoloading firearm, the method comprising the steps of:

providing a firearm with a receiver for chambering an ammunition cartridge, a barrel with a chamber end and a discharge end, a trigger mechanism configured to ignite said ammunition cartridge, a spring-loaded mobile slide operable to move along an axial length of said barrel, a cylindrical locking gas chamber ported to an inside of said barrel, a cylindrical compression gas chamber ported to the inside of said barrel, and a piston disposed within each said gas chamber and connected to said slide, each said piston being axially aligned within each said gas chamber and operable to slide into each said gas chamber as said slide moves along the axial length of said barrel;

producing expanding propellant gases having a pressure within said cartridge chamber upon igniting said ammunition cartridge;

flowing said propellant gases into said locking gas chamber and exerting a first gas pressure force on said piston within said locking gas chamber;

flowing said propellant gases into said compression gas chamber;

relieving said first gas pressure force from within said locking gas chamber;

exerting a second gas pressure force on said piston within said compression gas chamber; and relieving said second gas pressure force sufficient to allow said slide to slide to a full recoil position.

* * * * *